US008827776B1

(12) United States Patent
String

(10) Patent No.: US 8,827,776 B1
(45) Date of Patent: Sep. 9, 2014

(54) COIN SENSOR ARRANGEMENT FOR COIN PROCESSING MACHINE

(71) Applicant: GCCM, LLC, Harrisburg, PA (US)

(72) Inventor: Gregory F. String, Mechanicsburg, PA (US)

(73) Assignee: GCCM, LLC, Harrisburg, PA (US)

( * ) Notice: Subject to any disclaimer, the term of this patent is extended or adjusted under 35 U.S.C. 154(b) by 0 days.

(21) Appl. No.: 13/855,401

(22) Filed: Apr. 2, 2013

Related U.S. Application Data

(60) Provisional application No. 61/618,948, filed on Apr. 2, 2012.

(51) Int. Cl.
*G07D 3/00* (2006.01)
*G07D 3/14* (2006.01)
*G07D 5/02* (2006.01)

(52) U.S. Cl.
CPC ... *G07D 3/00* (2013.01); *G07D 3/14* (2013.01)
USPC ..... 453/3; 194/337

(58) Field of Classification Search
CPC ..... G07D 3/14; G07D 5/02; G07D 9/008
USPC ..... 453/3, 18, 29, 30, 32, 50; 194/334, 337, 194/293, 336; 221/303, 307
See application file for complete search history.

(56) References Cited

U.S. PATENT DOCUMENTS

| | | | | |
|---|---|---|---|---|
| 4,904,223 | A * | 2/1990 | Sentoku | 453/7 |
| 4,998,611 | A * | 3/1991 | Shuie | 194/337 |
| 7,243,774 | B2 | 7/2007 | String | |
| 8,172,654 | B2 | 5/2012 | String | |
| 2013/0059515 | A1 | 3/2013 | String | |

* cited by examiner

*Primary Examiner* — Mark Beauchaine
(74) *Attorney, Agent, or Firm* — Hooker & Habib, P.C.

(57) ABSTRACT

A coin sensor arrangement to sense the different diameters of coins in a singulated stream of coins moving along a coin path includes a movable member that is displaced from a first position to a second position by passage of the largest-diameter coins moving along the coin path. When the member reaches the second position, the member actuates the coin sensor arrangement to signal the presence of the coin. Actuation of the coin sensor arrangement can take place spaced away from the coin stream where possible contaminants that might affect sensing are less likely to be present.

17 Claims, 2 Drawing Sheets

COIN SENSOR ARRANGEMENT FOR COIN PROCESSING MACHINE

FIELD OF THE DISCLOSURE

This disclosure relates to coin processing machines, and more specifically, to sensing the diameter of coins and determining the denomination of coins thereby.

BACKGROUND OF THE DISCLOSURE

FIG. 1 illustrates in part a known coin processing machine 10 used for counting US currency, that is, for counting US coins (in decreasing coin diameter): half-dollars, dollars, quarter-dollars, nickels, pennies, and dimes. The coin processing machine 10 is described in my U.S. Pat. No. 8,172,654 "Coin Processing Machine with Pivoting Alignment Finger" that issued May 8, 2012, the disclosure of which is incorporated by reference as if fully set forth herein. The coin processing machine 10 has proven in practice to be a reliable and durable device that accurately sorts, counts, or verifies coins (even wet or oily coins) at high speed.

Coin processing machine 10 has a rotatable turntable 12 mounted in stationary plate 14. Turntable 12 has an upper coin support surface 16 flush with upper coin support surface 18 of plate 14.

Stationary raking finger 20 and stationary guide finger 22 are mounted on plate 14. Raking finger 20 and guide finger 22 define a first opening 24 that receives a singulated stream of coins from turntable 12. A raised peripheral wall (not shown) mounted to plate 14 partially surrounds the turntable 12 and has an opening aligned with opening 24 to enable coins leaving turntable 14 to move between fingers 20 and 22.

A belt drive for driving the singulated stream of coins along the plate 14 is disclosed in my U.S. Pat. No. 7,243,774 "High Speed Coin Processing Machine" that issued Jul. 17, 2007, the disclosure of which is incorporated by reference as if fully set forth herein. The belt drive (not shown) has a belt run located above plate 14. The belt run engages coins entering opening 24 and accelerates the coins towards coin through-slot 26 formed in plate 14. The belt drive spaces the coins apart as the coins move towards slot 26. The belt run urges the coins to move in a downstream direction along a first, planar guide surface 28. The belt preferably also urges the coins towards the guide surface 28 (that is, the belt run does not extend parallel with guide surface 28 but extends towards surface 28 in the downstream direction as the belt run extends towards slot 26).

Sensors 30*b* carried in plate 14 are located between opening 24 and slot 26. Each sensor 30*b* is associated with a different diameter coin (half-dollar, dollar, quarter-dollar, nickel, penny, dime) and is spaced a predetermined distance from the guide surface 28. The sensors 30*b* are arranged to first detect the largest diameter coin (in the illustrated embodiment a US half-dollar coin) and then detect each succeeding smaller-diameter coin as a coin in contact with guide surface 28 passes sensors 30*a*. The sensors 30*a* are connected to a controller (not shown) that records the denomination of each coin passing the sensors 30*a* and maintains a running count of the value of the coins discharged from the turntable 12.

A pair of sensors 30*a* associated with the half dollar and dollar coins are also carried in plate 14 and cooperate with respective half dollar and dollar coin sensors 30*a* as described in my co-pending U.S. patent application Ser. No. 13/223,858 "Coin Processing Machine with Dual Rows of Coin Sensors" filed 1 Sep. 2011, which application is incorporated by reference as if fully set forth herein.

A pivotable alignment finger 34 is mounted on plate 14 downstream from rake finger 20. Alignment finger 34 has a free end 36 that is spaced away from the first guide surface 28. The alignment finger 34 and the guide surface 28 define a second opening 37 that is downstream from the first opening 24 along the guide surface 28.

Alignment finger 34 pivots about mounting fastener 38. The range of motion of finger 34 is established by dowel pin 40 in circumferentially-elongate finger slot 42 between a normal operating position towards rake finger 20 and a retracted position away from rake finger 20. A spring 44 formed from thin spring steel plate engages finger 34 and urges the free end 36 of finger 34 towards the normal operating position.

Free end 36 of finger 34 extends sufficiently towards the first opening 24 to contact and engage larger-diameter coins passing through the opening as the coins move along guide surface 28. In other words, the width of the second opening 37 is less than the largest diameter of coin to be processed. Free end 36 includes a second guide surface 45 that faces the first opening 24. Guide surface 45 extends in a downstream direction towards the first guide surface 28.

When a larger-diameter coin passes through first opening 24, the coin contacts end 36 of finger 34 as it bears against guide surface 28. The lower belt run (represented schematically as arrow 47 extending in the downstream direction along the guide surface 28) forces the coin past alignment finger 34, deflecting spring 44 and moving the alignment finger 34 towards its retracted position. Movement of the alignment finger 34 enables the coin to continue moving through second opening 37 and pass by the finger end 36. Spring 44 urges the alignment finger quickly back to its normal position after the coin passes the alignment finger 34.

When a smaller-diameter coin passes through first opening 24 the alignment finger 34 is in its normal operating position as shown in FIG. 1. A smaller-diameter coin that is located closer to the raking finger 20 than the guide finger 22 may engage second guide surface 45 of the alignment finger 34 after the coin moves through the opening 24. Second guide surface 45 is configured to redirect the coin towards first guide surface 28 as the belt forces the coin downstream towards the second opening 37. The smaller-diameter coin has a diameter less than the opening 37 (that is, the smaller-diameter coin has a diameter less than the distance between finger 34 and guide surface 28 when the finger 34 is in its normal position).

The smaller-diameter coin is not compressed between finger 34 and guide surface 28 when it reaches the end of the guide surface 45 and enters the second opening 37, and so the smaller-diameter coin does not force the finger 34 away from its normal operating position. After the smaller-diameter coin passes finger 34, the belt continues the component of coin travel towards guide surface 28 to assure that the coin engages the guide surface 28 before reaching the sensors 30 for accurate discrimination and counting.

When a smaller-diameter coin is away from the raking finger 22 when passing through first opening 24, the coin may not engage finger 34. The coin, however, is sufficiently close to guide surface 28 that the belt will properly align the coin with respect to surface 28 before the coin reaches sensors 30.

If a larger-diameter coin is followed by a smaller-diameter coin, the spring 44 moves alignment finger 34 back to its normal position quickly so that the smaller-diameter coin may engage the guide surface 45 and be directed towards the guide surface 28 before the smaller-diameter coin reaches the second opening 37. Preferably the guide surface 45 extends towards the first guide surface 28 even when the alignment finger 34 has not yet returned to its normal position.

Alignment finger 34 is preferably mounted on plate 14 with a small amount of vertical play 46 (see FIG. 2) that enables the finger to move towards and away plate 14. The amount of play must be less than the minimum coin thickness, and is intended to enable dirt and other contaminants to pass under finger 34 without buildup. Spring 44 has an upper portion 49 that extends above and overhangs finger 34 with sufficient clearance to enable the desired vertical play. After lifting off plate 14, the upper surface of finger 34 engages the overhanging spring portion 49 to prevent further vertical movement of the finger.

The coin processing machine 10 reliably counts even wet or oily coins. However, if one of the coin sensors 30 (shown for example the half-dollar coin sensor 30*a*) is covered by a small piece of stray metal, the covered coin sensor 30*a* will always signal to the controller the presence of a coin even if the coin passing by the sensor 30*a* is a coin of a smaller diameter coin than the coin diameter associated with the sensor 30*a*. This problem is generally not a major problem with the sensors downstream from the most upstream sensor (the sensor associated with the largest diameter coin) because a coin will come by and sweep the metal off the sensor. However, the illustrated most upstream sensor 30*a* is associated with the half-dollar coin, and it may be quite awhile before another half-dollar coin comes along that will sweep any unwanted metal off the sensor 30*a*. As a result, there can be a substantial period during which coins that are not half-dollar coins may be miscounted as half-dollar coins.

Thus there is a need for an improved sensor arrangement that does not miscount the largest diameter coins because of metal contaminants overlying the sensor associated with those coins.

BRIEF SUMMARY OF THE DISCLOSURE

Disclosed is an embodiment of an improved sensor arrangement for use with coin sorting systems having a pivotable guide finger as described above that reduces the possibility of miscounting larger diameter coins because of metal contaminants overlaying the sensors associated with those coins.

The sensor arrangement includes a sensor that is placed in the path of the swing arc of the pivotable guide finger. The finger in the described embodiment moves over the sensor when a largest-diameter coin moves through the coin opening. When the guide finger moves over the sensor, the sensor generates a signal representing the presence of the largest-diameter coin to the controller. The controller can recognize the presence of the coin based solely on the signal generated by the additional sensor, or can recognize the presence of the coin based on simultaneous detection of the coin by one or more other coin sensors.

The disclosed embodiment utilizes the limiting pivotal movement of the guide finger to sense the presence of the largest coin diameter. Other embodiments of the invention could utilize some other movement of a movable member driven by coin contact to sense the presence of a coin. For example, instead of pivotal movement a coin could push a member guided to move in translation.

Other objects and features of the invention will become apparent as the description proceeds, especially when taken in conjunction with the accompanying drawing sheet illustrating an embodiment of the invention.

DESCRIPTION OF ONE OR MORE EMBODIMENTS

Figure 1:
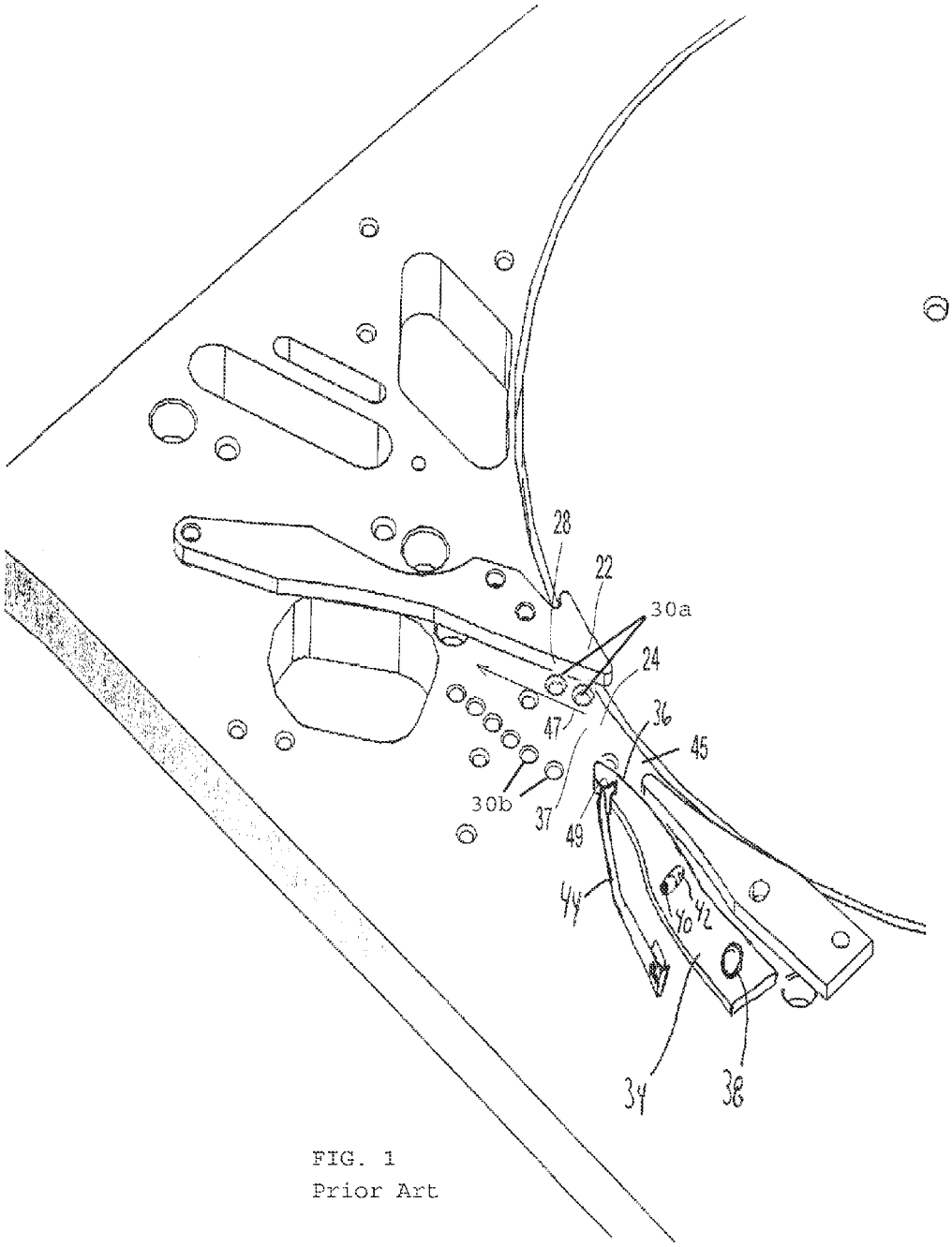
FIG. 1 Prior Art
FIG. 1 is a perspective view of a prior art coin processing machine having a known coin sensor arrangement.
Figure 2:
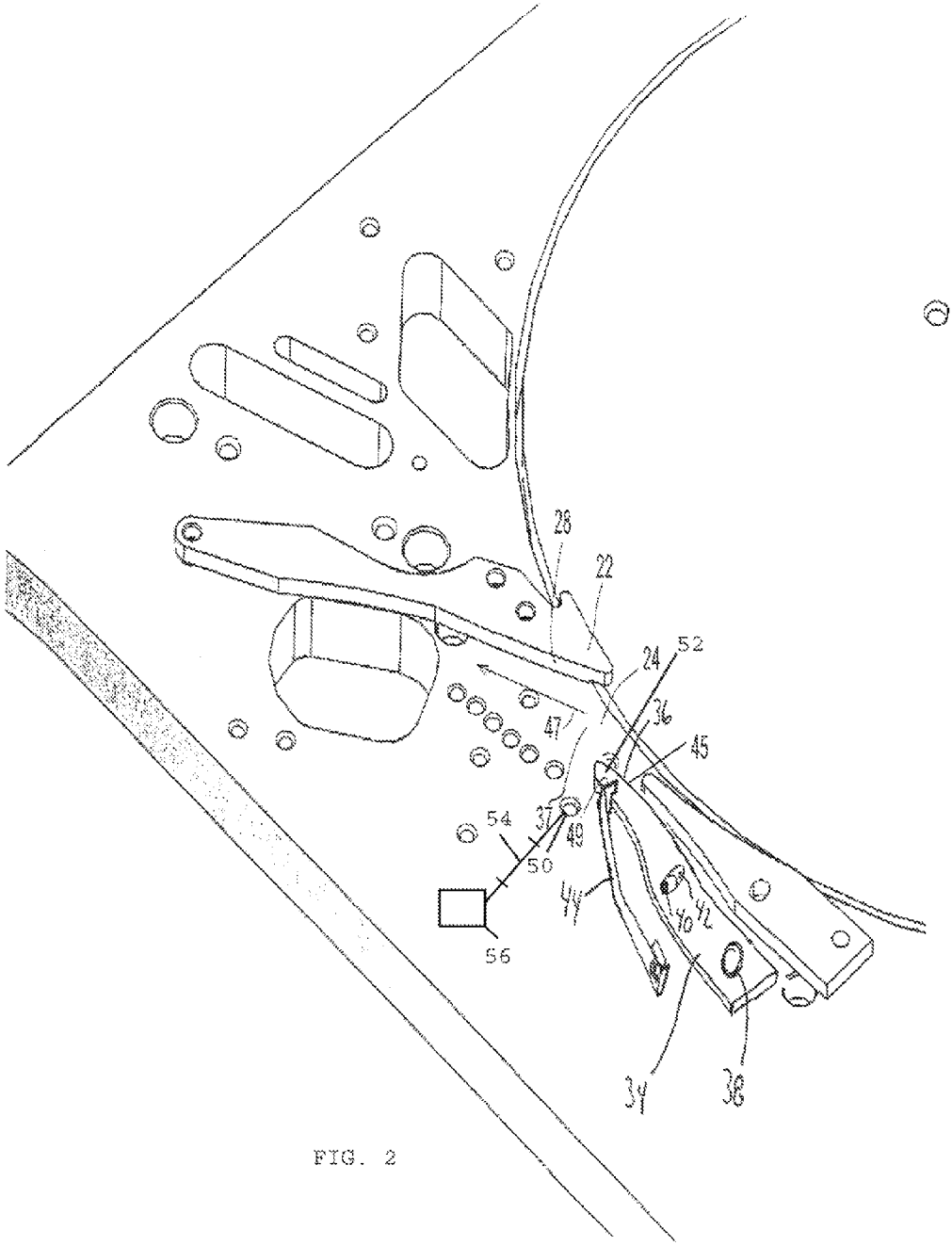
FIG. 2 is a perspective view of the coin processing machine shown in FIG. 1 but utilizing an embodiment of the coin sensor arrangement in accordance with the present invention.

FIG. 2 illustrates the coin machine 10 modified to utilize an embodiment of a coin sensor arrangement in accordance with an embodiment of the present invention. To reduce drawing clutter, coin sensors 30*a*, although present as shown in FIG. 1, are not shown in FIG. 2. The coin sensor arrangement includes an additional sensor 50 that is placed in the swing arc of the free end portion 52 of the pivoting finger 34 away from the spring 44. When a half-dollar coin passes through the opening 37, the free end portion 52 of the finger 34 moves over the sensor 50. That is, the pivoting finger 34 has sufficient range of motion that the finger end portion 52 moves over and past the sensor 50 when a half-dollar coin passes through the opening 37.

The pivoting finger 34, however, does not have a sufficient range of motion to move over and past the sensor 50 when a coin having a diameter less than the diameter of a half-dollar coin passes through the opening 37.

The pivoting finger 34 also is spaced upstream from the coin sensors 30*a* such that the pivotal movement of the finger 34 does not cover any one of the sensors 30*a*.

The finger end portion 52 is spaced sufficiently close to the plate 14 and the sensor 50 is disposed sufficiently close to the upper surface of the plate 14 such that the sensor 50 "sees" the finger end portion 52 when the finger end portion 52 moves over the sensor 50. That is, the sensor 50 generates a signal (represented by a signal line 54) that is transmitted to the controller 56 when the end portion 52 moves over the sensor 50. Thus the sensor 50 "fires" and generates the signal 54 transmitted to the controller 56 only when a half-dollar coin moves through the opening 37.

The controller programming disclosed in my co-pending published U.S. patent application Ser. No. 13/223,858 (published as US Patent Application Publication 20130059515 on Mar. 7, 2013, which publication is incorporated by reference as if fully set forth herein) is modified so that a half-dollar coin is counted only if the sensor 50 fires. The other coin sensors 30*a*, 30*b* associated with the half-dollar coin can optionally be removed or the controller programming can be changed to count a half-dollar coin only if the sensor 50 and either a sole sensor 30*a* or 30*b* associated with the half-dollar coin or both the sensors 30*a*, 30*b* associated with the half-dollar coin also fire to signal the presence of a coin.

Advantages of the disclosed embodiment include but are not necessarily limited to:

(a) the pivot arm 36 can be constructed such that the sensor 50 is away from the array of coin sensors 30*b* and so is likely away from contaminants carried onto the plate 14 by the coin stream that might otherwise cover and impair functioning of the sensor 50;

(b) the pivot arm 36 itself helps obstruct and prevent contaminants discharged from the turntable 12 from reaching the sensor 50 and may even help prevent contaminants from reaching the sensors 30*a*; and (c) motion of the pivot arm 36 can help sweep contaminants off the sensor 50.

Although the illustrated coin machine 10 utilizes a belt drive to drive and separate the singulated stream of coins on the plate 14, other ways of driving and separating a singulated stream of coins on a plate are known in the coin processing art and can be adapted for use with the sensor arrangement of the present invention.

The portion of the pivoting arm 37 that covers the sensor 50 can extend away from the portion of the arm 37 that contacts a half-dollar coin or can extend from the remainder of the arm 37 in a direction more transverse to the guide surface 28 so that the sensor 50 can be spaced further away from the stream of coins and contamination carried by the stream of coins. In other words, the shape of the arm 37 can differ from that shown. In yet other possible embodiments of the present invention motion or angular displacement of the pivot finger 37 caused by the passage of a half-dollar can press a button or other mechanical, electromechanical, or electronic input device or actuator to signal or otherwise detect passage of a half-dollar coin.

It should be understood that although the disclosed embodiment of the invention is described in relation to US denomination coins, this is not limiting and the invention can be readily adapted for use with coin denominations of other countries, tokens, or similar sets of objects.

Although the illustrated embodiment is used in sorting or verifying coins used as legal currency, it is understood the term "coins" also includes tokens, disks, and the like that may not necessarily be legal currency.

While one or more embodiments have been disclosed, it is understood that this is capable of modification, and that the teachings of the disclosure are not limited to the precise details set forth but encompasses such changes and alterations as fall within the purview of the following claims.

What is claimed is:

1. A coin processing machine for serially processing coins of various denominations, each denomination coin having a respective coin diameter different than the diameters of coins of other denominations and including a largest-diameter coin and one or more smaller-diameter coins, each coin having an annular outer edge extending around opposite faces of the coin, the coin processing machine comprising:

a guide surface, a first sensor, a second sensor, a member movable with respect to the guide surface between first and second positions, and a controller for generating an output signal representing the denomination of a coin being processed by the coin machine;

the guide surface having a length extending in a downstream direction, the guide surface defining a side of a coin path extending in the downstream direction beside and along the length of the guide surface wherein a coin having the outer edge of the coin against the guide surface and moving downstream along the guide surface is moving on a coin path;

the movable member spaced from the guide surface, the movable member when in the first position cooperating with the guide surface to define a gap therebetween, the coin path extending through the gap, the gap sized to be smaller than the largest-diameter coin but larger than the next-smaller sized coin wherein a largest-diameter coin moving on the coin path against the guide surface contacts the movable member and urges the movable member to the second position to enable the largest-diameter coin to move past the member while on the coin path and wherein a smaller-diameter coin moving on the coin path passes through the gap without engaging the member;

the first sensor disposed to face the member when the member is in the second position and the first sensor is disposed to not face the member when the member is in the first position;

the first sensor being capable of generating a signal indicating that the member is in the second position when the first sensor faces the member; and the controller receiving the signal generated by the first sensor, the controller configured to utilize the signal in determining whether or not to generate an output signal representing a largest-diameter coin in response to a coin moving along the coin path;

the second sensor being spaced from the guide surface such that the second sensor will sense only largest-diameter coins moving downstream along the coin path;

the second sensor being capable of generating a signal representing the presence of a coin when a coin faces the second sensor, the controller receiving the signal generated by the second sensor;

the controller being configured to generate an output signal representing a largest-diameter coin when the controller receives signals from both the first and second sensors in response to a coin moving along the coin path.

2. The coin processing machine of claim 1 wherein the movable member is configured for pivotal movement about an axis.

3. The coin processing machine of claim 1 including a support member having a flat coin-support surface adjacent the guide surface, the coin path on said coin-support surface, the second sensor mounted in said support member; and the movable member is disposed above the coin-support surface, the second sensor is spaced away from the movable member such that the movable member does not move over the second sensor when moving from the first position to the second position.

4. The coin processing machine of claim 1 comprising a third sensor, the third sensor capable of generating a signal representing the presence of a coin when a coin faces the third sensor, the controller receiving the signal generated by the third sensor, the second and third sensors disposed to simultaneously sense a large-diameter coin moving downstream along the coin path, the controller configured to generate an output signal representing a largest-diameter coin when the controller receives signals from the first, second, and third sensors in response to a coin moving along the coin path.

5. The coin processing machine of claim 4 wherein the controller is configured to output a signal representing a largest-diameter coin when the first, second, and third sensors simultaneously signal the presence of a coin in response to a coin moving along the coin path.

6. A coin processing machine for serially processing coins of various denominations, each denomination coin having a respective coin diameter different than the diameters of coins of other denominations and including a largest-diameter coin and one or more smaller-diameter coins, each coin having an annular outer edge extending around opposite faces of the coin, the coin processing machine comprising:

a guide surface, a first sensor, a second sensor, a third sensor, a member movable with respect to the guide surface between first and second positions, and a controller for generating an output signal representing the denomination of a coin being processed by the coin machine;

the guide surface having a length extending in a downstream direction, the guide surface defining a side of a coin path extending in the downstream direction beside and along the length of the guide surface wherein a coin having the outer edge of the coin against the guide surface and moving downstream along the guide surface is moving on a coin path;

the movable member being spaced from the guide surface, the movable member when in the first position cooperating with the guide surface to define a gap therebetween, the coin path extending through the gap, the gap sized to be smaller than the largest-diameter coin but larger than the next-smaller sized coin wherein a largest-diameter coin moving on the coin path against the guide surface contacts the movable member and urges the movable member to the second position to enable the largest-diameter coin to move past the member while on the coin path and wherein a smaller-diameter coin moving on the coin path passes through the gap without engaging the member;

the first sensor being disposed to face the member when the member is in the second position and the first sensor is disposed to not face the member when the member is in the first position;

the first sensor being capable of generating a signal indicating that the member is in the second position when the first sensor faces the member; and the controller receiving the signal generated by the first sensor, the controller configured to utilize the signal in determining whether or not to generate an output signal representing a largest-diameter coin in response to a coin moving along the coin path;

the second sensor being capable of generating a signal representing the presence of a coin when a coin faces the second sensor, the controller receiving the signal generated by the second sensor, the controller configured to generate an output signal representing a largest-diameter coin when the controller receives signals from both the first and second sensors in response to a coin moving along the coin path;

the third sensor being capable of generating a signal representing the presence of a coin when a coin faces the third sensor, the controller receiving the signal generated by the third sensor, the second and third sensors disposed to simultaneously sense a large-diameter coin moving downstream along the coin path, the controller configured to generate an output signal representing a largest-diameter coin when the controller receives signals from the first, second, and third sensors in response to a coin moving along the coin path; and the second sensor being spaced a first distance from the guide surface and the third sensor being spaced a second distance greater than the first distance from the guide surface.

7. The coin processing machine of claim 6 wherein the second sensor is spaced from the guide surface such that the second sensor will sense only largest-diameter coins moving downstream along the coin path.

8. The coin processing machine of claim 6 including a support member having a flat coin-support surface adjacent the guide surface, the coin path on said coin-support surface, the second sensor mounted in said support member; and the movable member is disposed above the coin-support surface, the second sensor is spaced away from the movable member such that the movable member does not move over the second sensor when moving from the first position to the second position.

9. The coin processing machine of claim 6 wherein the controller is configured to output a signal representing a largest-diameter coin when the first, second, and third sensors simultaneously signal the presence of a coin in response to a coin moving along the coin path.

10. A coin processing machine for serially processing coins of various denominations, each denomination coin having a respective coin diameter different than the diameters of coins of other denominations and including a largest-diameter coin and one or more smaller-diameter coins, each coin having an annular outer edge extending around opposite faces of the coin, the coin processing machine comprising:

a guide surface, a first sensor, a member movable with respect to the guide surface between first and second positions, and a controller for generating an output signal representing the denomination of a coin being processed by the coin machine;

the guide surface having a length extending in a downstream direction, the guide surface defining a side of a coin path extending in the downstream direction beside and along the length of the guide surface wherein a coin having the outer edge of the coin against the guide surface and moving downstream along the guide surface is moving on a coin path;

the movable member spaced from the guide surface, the movable member when in the first position cooperating with the guide surface to define a gap therebetween, the coin path extending through the gap, the gap sized to be smaller than the largest-diameter coin but larger than the next-smaller sized coin wherein a largest-diameter coin moving on the coin path against the guide surface contacts the movable member and urges the movable member to the second position to enable the largest-diameter coin to move past the member while on the coin path and wherein a smaller-diameter coin moving on the coin path passes through the gap without engaging the member;

the first sensor disposed to face the member when the member is in the second position and the first sensor is disposed to not face the member when the member is in the first position;

the first sensor being capable of generating a signal indicating that the member is in the second position when the first sensor faces the member;

the controller receiving the signal generated by the first sensor, the controller configured to utilize the signal in determining whether or not to generate an output signal representing a largest-diameter coin in response to a coin moving along the coin path;

the movable member being configured for pivotal movement about an axis;

the movable member comprising a free end portion, the free end portion covering the first sensor when the movable member is in the second position.

11. The coin processing machine of claim 10 wherein the controller is configured to generate an output signal representing a largest-diameter coin whenever the controller receives a signal from the first sensor.

12. The coin processing machine of claim 10 comprising a second sensor, the second sensor capable of generating a signal representing the presence of a coin when a coin faces the second sensor, the controller receiving the signal generated by the second sensor, the controller configured to generate an output signal representing a largest-diameter coin when the controller receives signals from both the first and second sensors in response to a coin moving along the coin path.

13. The coin processing machine of claim 12 wherein the second sensor is spaced from the guide surface such that the second sensor will sense only largest-diameter coins moving downstream along the coin path.

14. The coin processing machine of claim 12 including a support member having a flat coin-support surface adjacent the guide surface, the coin path on said coin-support surface, the second sensor mounted in said support member; and the movable member is disposed above the coin-support surface, the second sensor is spaced away from the movable member such that the movable member does not move over the second sensor when moving from the first position to the second position.

15. The coin processing machine of claim 12 comprising a third sensor, the third sensor capable of generating a signal representing the presence of a coin when a coin faces the third sensor, the controller receiving the signal generated by the third sensor, the second and third sensors disposed to simultaneously sense a large-diameter coin moving downstream along the coin path, the controller configured to generate an output signal representing a largest-diameter coin when the controller receives signals from the first, second, and third sensors in response to a coin moving along the coin path.

16. The coin processing machine of claim 15 wherein the controller is configured to output a signal representing a largest-diameter coin when the first, second, and third sensors simultaneously signal the presence of a coin in response to a coin moving along the coin path.

17. The coin processing machine of claim 10 wherein the movable member is pivotable about a pivot axis.

* * * * *